United States Patent [19]

Kromm, Jr. et al.

[11] 4,426,953

[45] Jan. 24, 1984

[54] HEAT PRESSURE FUSER APPARATUS

[75] Inventors: Alvin D. Kromm, Jr., Webster; Rabin Moser, Fairport, both of N.Y.

[73] Assignee: Xerox Corporation, Stamford, Conn.

[21] Appl. No.: 403,453

[22] Filed: Jul. 30, 1982

[51] Int. Cl.[3] ..... B05C 11/00

[52] U.S. Cl. ..... 118/60; 118/104; 432/60; 432/75

[58] Field of Search ..... 118/60, 261, 104; 432/60, 75

[56] References Cited

U.S. PATENT DOCUMENTS

| | | | |
|---|---|---|---|
| 3,182,632 | 5/1965 | Vazdikis | 118/104 |
| 3,312,191 | 4/1967 | Lowe | 118/104 |
| 3,964,431 | 6/1976 | Namiki | 118/60 |
| 4,214,549 | 7/1980 | Moser | 118/60 |

*Primary Examiner*—Evan K. Lawrence

[57] ABSTRACT

A heat and pressure roll fusing apparatus for fixing toner images to copy substrates. The apparatus includes a release agent management system (RAM) for applying release agent such as functional silicone oil to a heated roll of the apparatus. The RAM comprises a donor roll, a metering roll and a metering blade which cooperate to convey silicone oil from a sump to the surface of the heated roll. The metering roll which is contacted by the metering blade is provided with a helical groove which acts to scrape the tip of the metering blade as the metering roll rotates and move paper related residue dislodged therefrom to the end of the metering roll where it is collected for subsequent disposal.

8 Claims, 2 Drawing Figures

HEAT PRESSURE FUSER APPARATUS

BACKGROUND OF THE INVENTION

This invention relates generally to xerographic copying apparatus, and more particularly, it relates to the heat and pressure fixing of particulate thermoplastic toner by direct contact with a heated fusing member having a release fluid on the surface thereof.

In the process of xerography, a light image of an original to be copied is typically recorded in the form of a latent electrostatic image upon a photosensitive member with subsequent rendering of the latent image visible by the application of electroscopic marking particles, commonly referred to as toner. The visible toner image can be either fixed directly upon the photosensitive member or transferred from the member to another support, such as a sheet of plain paper, with subsequent affixing of the image thereto in one of various ways, for example, by the application of heat and pressure.

In order to affix or fuse electroscopic toner material onto a support member by heat and pressure, it is necessary to elevate the temperature of the toner material to a point at which the constituents of the toner material coalesce and become tacky while simultaneously applying pressure. This action causes the toner to flow to some extent into the fibers or pores of support members or otherwise upon the surfaces thereof. Thereafter, as the toner material cools, solidification of the toner material occurs causing the toner material to be bonded firmly to the support member. In both the xerographic as well as the electrographic recording arts, the use of thermal energy and pressure for fixing toner images onto a support member is old and well known.

One approach to heat and pressure fusing of electroscopic toner images onto a support has been to pass the support with the toner images thereon between a pair of opposed roller members, at least one of which is internally heated. During operation of a fusing system of this type, the support member to which the toner images are electrostatically adhered is moved through the nip formed between the rolls with the toner image contacting the fuser roll thereby to effect heating of the toner images within the nip. By controlling the heat transferred to the toner, virtually no offset of the toner from the copy sheet to the fuser roll is experienced under normal conditions. This is because the heat applied to the surface of the roller is insufficient to raise the temperature of the surface of the roller above the "hot offset" temperature of the toner whereat the toner particles in the image areas of the toner liquify and cause a splitting action in the molten toner resulting in "hot offset". Splitting occurs when the cohesive forces holding the viscous toner mass together is less than the adhesive forces tending to offset it to a contacting surface such as a fuser roll.

Occasionally, however, toner particles will be caused to be offset to the fuser roll due to insufficient application of heat to the surface thereof (i.e. "cold" offsetting); by imperfections in the properties of the surface of the roll; or by the toner particles insufficiently adhering to the copy sheet by the electrostatic forces which normally hold them there. In such a case, toner particles may be transferred to the surface of the fuser roll with subsequent transfer to the backup roll during periods of time when no copy paper is in the nip.

Moreover, toner particles can be picked up by the fuser and/or backup roll during fusing of duplex copies or simply from the surroundings of the reproducing apparatus.

One arrangement for minimizing the foregoing problems, particularly that which is commonly referred to as "offsetting", has been to provide a fuser roll with an outer surface or covering of polytetrafluoroethylene, known by the trade name, Teflon, to which a release agent such as silicone oil is applied, the thickness of the Teflon being on the order of several mils and the thickness of the oil being less than 1 micron. Silicone based oils, (polydimethylsiloxane), which possess a relatively low surface energy, have been found to be materials that are suitable for use in the heated fuser roll environment where Teflon constitutes the outer surface of the fuser roll. In practice, a thin layer of silicone oil is applied to the surface of the heated roll to form an interface between the roll surface and the toner images carried on the support material. Thus, a low surface energy layer is presented to the toner as it passes through the fuser nip and thereby prevents toner from offsetting to the fuser roll surface.

A fuser roll construction of the type described above is fabricated by applying in any suitable manner a solid layer of abhesive material to a rigid core or substrate such as the solid Teflon outer surface or covering of the aforementioned arrangement.

In attempts to improve at least the perceived quality of the image fused or fixed by a heated roll fuser, such rolls have been provided with conformable surfaces comprising silicone rubber or Viton (Trademark of E. I. duPont for a series of fluoroelastomers based on the copolymer of vinylidene fluoride and hexafluoroproplyene). As in the case of the Teflon coated fuser roll release fluids such as silicone based oils have been applied to the surface of the silicone rubber or Viton to both minimize offsetting and to facilitate stripping. See, for example, U.S. Pat. No. 3,964,431. When the fuser system is one which provides for applying silicone oil to silicone rubber or Viton a low viscosity silicone oil (i.e. on the order to 100–1000 cs) has most commonly been employed.

Most recently, functional silicone oils (i.e. oils that chemically interact with metallic or metal containing surfaces) have been discovered for use as release coatings on fuser rolls. These materials are considered to be less thermally stable than the conventional non-functional silicone oils therefore necessitate certain precautions in their handling, particularly, in the standby mode of operation. For example, it has been found that the conventional methods (i.e. hot fuser roll contacts release material in a sump with subsequent metering with a blade) of applying functional release materials to heated fuser rolls shortens the life of these types of release agent materials.

SUMMARY OF THE INVENTION

One arrangement for metering functional silicone oils to a heated fuser roll which solved the aforementioned problem as illustrated in U.S. Pat. No. 4,214,549 comprises a donor roll fabricated from a heat insulative and deformable material, for example, silicone rubber which transfers the functional release material from a metering roll contacting a supply of release material contained in a sump to the heated fuser roll. A metering blade is supported in contact with the metering roll for metering the release material onto the metering roll to a thickness such that 1$\mu$l of oil is dispersed per copy. Heretofore, in a commercial embodiment of the foregoing release agent management system, the relative roughness of the metering roll was relied upon to clean the tip of the metering blade. We discovered that when relatively smooth metering rolls were used paper related residue collected at or near the tip of the metering blade caused uneven (i.e. streaky) metering of the release material to the metering roll and hence to the heated fuser roll as well as increased oil consumption.

Briefly, in accordance with the present invention the problems caused by paper related residue collecting at or near the metering blade tip were solved by providing the metering roll with a helical groove which is cut into the surface thereof, the groove being shallow enough to allow the metering blade to conform to the surface of the metering roll. One of the walls forming the helical groove acts as a scraper for the blade to scrape the residue therefrom and move it to one side of the roll via the longitudinal axis thereof. The metering roll is adopted to be supported so that either of the walls forming the groove can act to scrape the metering blade.

BRIEF DESCRIPTION OF THE DRAWINGS

The preferred embodiment of the invention will now be discussed with reference to the drawings wherein.

DESCRIPTION OF THE PREFERRED EMBODIMENT OF THE INVENTION

Figure 1:
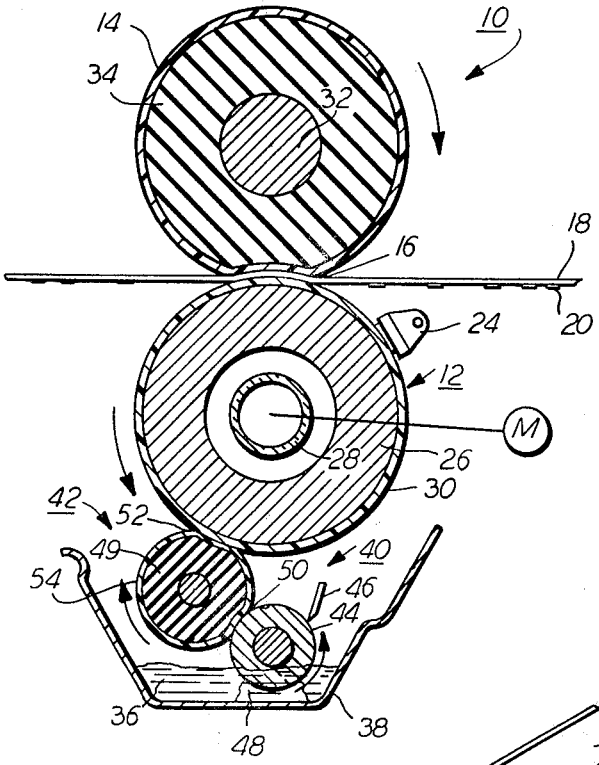
FIG. 1 is a schematic side elevational view of a roll fuser apparatus incorporating the invention.

Referring to FIG. 1, it can be seen that the improvement is directed to a roll fuser apparatus generally indicated 10. The fuser apparatus comprises a heated roll structure 12 cooperating with a non-heated backup roll structure 14 to form a nip 16 through which a copy substrate 18 passes with toner images 20 formed thereon in a well known manner. The toner images 20 contact the heated roll structure while a force is applied between the roll structures in a well known manner to create pressure therebetween resulting in the deformation of the backup roll structure by the heated roll structure to thereby form the nip 16.

As the substrate passes out of the nip, it is stripped from the heated roll structure by a plurality of air stripping devices (not shown) after which it is free to move along a predetermined path toward the exit of the machine (not shown) in which the fuser apparatus 10 is to be utilized.

A contact temperature sensor 24 is provided for sensing the surface temperature of the roll structure 12 and in conjunction with conventional circuitry (not shown) maintains the surface temperature to a predetermined value, for example, in the order of 375°–400° F.

The heated roll structure 12 comprises a hollow cylinder 26 having a radiant quartz heater 28 disposed in the hollow thereof. When suitably energized via the aforementioned circuitry, the heating element radiates heat to the cylinder which is then conducted to the outer surface of an outer layer 30 of the structure 12 which preferably comprises Viton having a thickness of 0.008 inch.

The backup roll structure 14 comprises a solid metal core 32 to which is adhered a relatively thick layer 34 of deformable material, for example, an elastomer known as ethylene-propylene terpolymer which is based on stereosperific linear typolymers of ethylene, propylene and small amounts of non-conjugated diene which is commonly referred to as EPDM which layer carries a thin overcoat of PFA 35. Due to the construction of the backup roll structure it is deformed by the harder heated roll structure when the required pressure is applied therebetween, the pressure being a function of the desired deformation which corresponds to the desired length of the nip 16.

While the layer 30 tends to be adhesive, therefore, exhibits a low affinity for the toner material 20, it has been found desirable to coat the layer with a release agent material 36 contained in a sump 38. The material 36 comprises a polymeric release agent having functional groups such as carboxy, hydroxy, epoxy, ammo, isogenate, thioether or mercepto groups.

For the purpose of coating the heated roll structure 12 there is provided a release agent management system generally indicated 40. The mechanism 40 comprises a donor roll 42, metering roll 44 and a metering blade 46.

The metering roll 44 is partially immersed in the release agent material 36 and is supported for rotation such that it is contacted by the donor roll 42 which, in turn, is supported so as to be contacted by the heated roll structure 12. As can be seen, the orientation of the rolls 42 and 44 is such as to provide a path for conveying material 36 from the sump to the surface of the heated roll structure 12. The metering roll is preferably a steel-surfaced roll having a 4–32 AA finish. The metering roll has an outside diameter of 0.75 inch. As mentioned above, the metering roll is supported for rotation, such rotation being derived by means of the positively driven heated roll structure 12 via the rotatably supported donor roll 42. In order to permit rotation of (at a practical input torque to the heated roll structure 12) the metering roll 44 is this manner the donor roll 42 comprises a deformable layer 49 which forms a first nip 50 between the metering roll and the donor roll and a second nip 52 between the latter and the heated roll. The nips 50 and 52 also permit satisfactory release agent transfer between the rolls and roll structure. Suitable nip lengths are 0.10 inch.

The wick 48 is fully immersed in the release agent and contacts the surface of the metering roll 44. The purpose of the wick is to provide an air seal which disturbs the air layer formed at the surface of the roll 44 during rotation thereof. If it were not for the function of the wick, the air layer would be coextensive with the surface of the roll immersed in the release agent thereby precluding contact between the metering roll and the release agent.

The metering blade 46, preferably fabricated from Viton, is $\frac{3}{4} \times \frac{1}{8}$ in cross section and has a length coextensive with the metering roll. The edge of the blade contacting the metering roll has a radius of 0.001–0.010 inch. The blade functions to meter the release agent picked up by the roll 44 to a predetermined thickness, such thickness being of such a magnitude as to result in one to several microliters of release agent consumption per copy.

The donor roll 42 has an outside diameter of 0.813 inch when the metering roll's outside diameter equals 0.75 inch. It will be appreciated that other dimensional combinations will yield satisfactory results. For example, 1.5 inch diameter rolls for the donor and metering rolls have been employed. The deformable layer 49 of the donor roll preferably comprises silicone rubber. However, other materials may also be employed.

A thin sleeve 54 on the order of several mils, constitutes the outermost surface of the roll 42, the sleeve material comprises Teflon. While the donor roll may be employed without the sleeve 54, it has been found that when the sleeve is utilized, contaminants such as lint on the heated roll 12 will not readily transfer to the metering roll 44. Accordingly, the material in the sump will not become contaminated by such contaminants.

Figure 2:
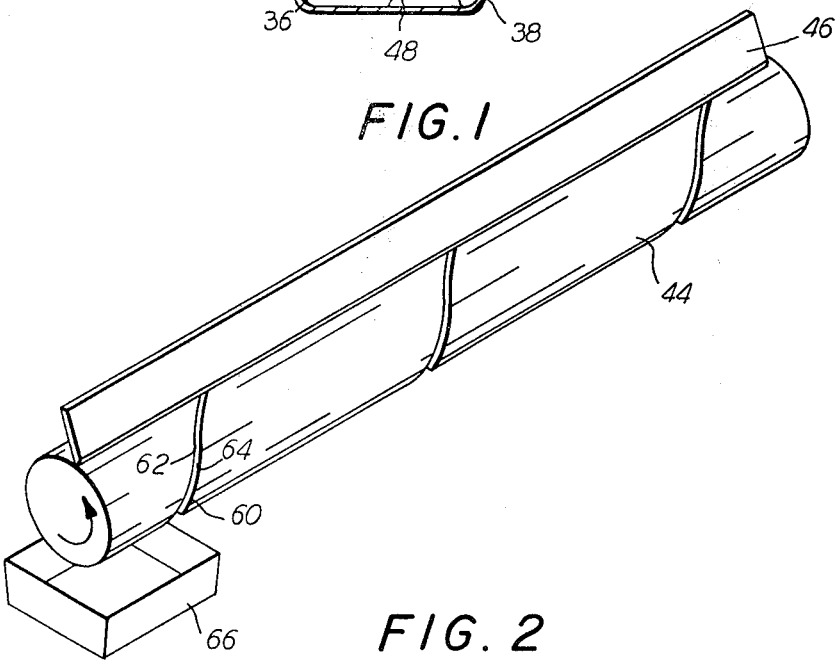
FIG. 2 is a perspective view of a metering roll forming a part of a release agent management system incorporated in the fuser apparatus of FIG, 1.

However, since transfer of paper related residue hereinbefore referenced to as lint to the metering roll can not be completely eliminated such transferred residue tends to collect at or near the tip of the metering blade 46. To remove the residue we have provided the metering roll 44, as shown in FIG. 2, with a helical groove 60 which is coextensive with the longitudinal axis of the roll. The groove is preferably in the order of 0.001 to 0.005 inch which is shallow enough to allow the metering blade to conform to the surface of the metering roll. The groove 60 is delineated by substantially vertical walls 62 and 64 the latter of which acts as a scraper to move residue collected at the tip of the blade 46 to one end of the metering roll to be received in a receptacle 66 supported adjacent that one end. It will be appreciated that the orientation of the metering roll could be reversed in order to utilize the other vertical wall 62 for scraping should the wall 64 become ineffective after prolonged use.

As can now be seen an improved fuser apparatus has been provided by virtue of structure adapted to remove paper related residue from the proximity of the tip of a metering blade forming a part of a improved release agent management system. Removal of the residue extends the useful life of the release management system and negates the need for the performance of maintenance to manually remove the paper related residue.

We claim:

1. A release agent management system for applying liquid release agent material to the surface of a rotating heated fuser roll, said system comprising:

a rotatable donor roll contacting said heated roll for applying said release agent material to said heated roll;

a rotatable metering roll contacting said donor roll and for contacting said release agent material contained in a sump for applying said release agent material to said donor roll;

a metering blade supported in contact with said metering roll for metering the release agent material picked up from said sump to a predetermined level; and means for dislodging paper related residue from said metering blade and transporting it toward one end of said metering blade.

2. Apparatus according to claim 1 wherein said means comprises one of the vertical walls delineating a helical groove formed in said metering roll, said groove being shallow enough to allow said metering blade to conform to the surface of said metering roll.

3. Apparatus according to claim 2 where said groove is 0.001 to 0.005 of an inch deep.

4. Apparatus according to claim 3 including means adjacent said one end for collecting said paper related residue.

5. Roll fuser apparatus for fixing toner images to copy sheets, said apparatus comprising:

a rotatable heated fuser roll;

a rotatable pressure roll supported in pressure engagement with said heated fuser roll;

a rotatable donor roll contacting said heated roll for applying a release agent material to said heated roll;

a rotatable metering roll contacting said donor roll and for contacting said release agent material contained in a sump for applying said release agent material to said donor roll;

a metering blade supported in contact with said metering roll to meter the release agent material picked up from said sump to a predetermined level; and means for dislodging paper related residue from said metering blade and transporting it toward one end of said metering blade.

6. Apparatus according to claim 5 wherein said means comprises one of the vertical walls delineating a helical groove formed in said metering roll, said groove being shallow enough to allow said metering blade to conform to the surface of said metering roll.

7. Apparatus according to claim 6 wherein said groove is 0.001 to 0.005 of an inch deep.

8. Apparatus according to claim 7 including means adjacent said one end for collecting said paper related residue.

* * * * *